US009836001B2

(12) United States Patent
Itagaki

(10) Patent No.: US 9,836,001 B2
(45) Date of Patent: Dec. 5, 2017

(54) IMAGE FORMING APPARATUS HAVING MEASURING UNIT

(71) Applicant: CANON KABUSHIKI KAISHA, Tokyo (JP)

(72) Inventor: Tomohisa Itagaki, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/189,350

(22) Filed: Jun. 22, 2016

(65) Prior Publication Data

US 2017/0038716 A1 Feb. 9, 2017

(30) Foreign Application Priority Data

Aug. 3, 2015 (JP) ..... 2015-153699

(51) Int. Cl.
*G03G 15/00* (2006.01)

(52) U.S. Cl.
CPC ..... *G03G 15/5058* (2013.01); *G03G 15/55* (2013.01); *G03G 2215/00611* (2013.01); *G03G 2215/00616* (2013.01)

(58) Field of Classification Search
CPC ..... G03G 15/50; G03G 15/55; G03G 2215/00611; G03G 2215/00616
See application file for complete search history.

(56) References Cited

U.S. PATENT DOCUMENTS 6,321,044 B1 11/2001 Tanaka
8,131,175 B2 * 3/2012 Kim ..... G03G 21/00 399/302
8,908,225 B2 12/2014 Zaima et al.
8,929,757 B2 1/2015 Shirafuji et al.
8,958,123 B2 2/2015 Itagaki
2010/0014878 A1 * 1/2010 Tomita ..... G03G 15/0131 399/49
2014/0050496 A1 * 2/2014 Furuta ..... G01J 3/46 399/49

(Continued)

OTHER PUBLICATIONS

Machine translation of Abstract of reference Sata (JP Pub No. 2012-189,895 A) Pub date Oct. 4, 2012.*

(Continued)

*Primary Examiner* — Rodney Bonnette
(74) *Attorney, Agent, or Firm* — Fitzpatrick, Cella, Harper & Scinto

(57) ABSTRACT

An image forming apparatus includes an image forming unit configured to form measurement images used for density correction at different timings using pseudo halftone processing patterns and a density detection sensor for detecting density of an object to be detected on an optical path including the formed measurement image. Further, the image forming apparatus includes a shutter which is arranged in the optical path between a density detection sensor and the measurement image, changed, by a motor, to a closed state in which a detecting surface of the density detection sensor is closed when the measurement image is not detected, and changed to an open state in which the detecting surface of the density detection sensor is opened when the measurement image is detected. Further, the image forming apparatus includes a controller which changes an image forming condition based on the detection result of the density detection sensor.

15 Claims, 10 Drawing Sheets

(56) References Cited

U.S. PATENT DOCUMENTS

| | | | | |
|---|---|---|---|---|
| 2015/0277319 | A1* | 10/2015 | Tani | G03G 15/50 399/74 |
| 2015/0277320 | A1* | 10/2015 | Tani | G03G 15/5033 399/74 |
| 2016/0216636 | A1 | 7/2016 | Itagaki | |
| 2016/0313685 | A1* | 10/2016 | Yamana | G03G 15/5054 |

OTHER PUBLICATIONS

Drawings of reference Sata (JP Pub No. 2012-189,895 A) Pub date Oct. 4, 2012.*

* cited by examiner

IMAGE FORMING APPARATUS HAVING MEASURING UNIT

BACKGROUND OF THE INVENTION

Field of the Invention

The present disclosure relates to an image forming apparatus.

Description of the Related Art

In an image forming apparatus such as electrophotographic type image forming apparatus, due to an environmental condition such as temperature and humidity and charged amount of toner of developer, density of an output image and a relative position of an image with respect to a sheet change. Thereby, the image forming apparatus forms a measurement image and corrects the density of the output image based on a measurement result of the measurement image by a sensor. Also, the image forming apparatus adjusts an image forming condition for adjusting the relative position of the image with respect to the sheet.

Conventionally, to prevent adhesion of scattering paper dust or toner on a detecting surface of a sensor, an image forming apparatus comprising a sensor with a shutter and that controls opening/closing operation of the shutter through an opening/closing mechanism is known (U.S. Pat. No. 6,321,044).

However, in the image forming apparatus of this type, if the toner or stain is adhered on the opening/closing mechanism of the shutter, sometimes, the shutter cannot normally be opened/closed. In this case, the sensor may receive reflection light from a rear side of the shutter at a timing when the density of the measurement image is detected. Due to this, when a sensor output value for the measurement image is wrongly detected, it is not possible to control, with high accuracy, an image forming condition of the image forming apparatus.

Thus, the present invention is directed to restrict the image forming condition from being adjusted by the measurement result of the sensor measured when the shutter is not normally opened.

SUMMARY OF THE INVENTION

The image forming apparatus of the present disclosure comprises an image forming apparatus comprising an image bearing member; an image forming unit configured to form an image on the image bearing member; a measuring unit having a first sensor, a second sensor, and a shutter, and configured to measure a measurement image formed on the image bearing member, wherein the shutter protects the first sensor and the second sensor; a driving unit configured to be driven to move the shutter, wherein, in a state in which the shutter is at a first position, the shutter prohibits measurement of the measurement image by the first sensor and the second sensor and wherein, in a state in which the shutter is at a second position, the measurement image is measured by the first sensor and the second sensor; and a controller configured to: control the image forming unit to form the measurement image on the image bearing member, drive the driving unit to move the shutter to the second position, control the measurement unit to measure the measurement image, control whether or not to change an image forming condition of the image forming unit based on a first output value corresponding to a measurement result of the first sensor and a second output value corresponding to a measurement result of the second sensor.

Further features of the present invention will become apparent from the following description of exemplary embodiments (with reference to the attached drawings).

DESCRIPTION OF THE EMBODIMENTS

In the following, embodiments are described with reference to the accompanying drawings. In the present embodiment, a description is provided with an example of an electrophotographic laser beam printer, which is an example of the image forming apparatus. Further, as the image forming apparatus, other image forming apparatus, such as inkjet printer, sublimation type printer, etc., can be used.

Further, according to the present embodiment, it is possible to prevent the image forming condition of the image forming apparatus from being adjusted based on the measurement result of the sensor measured when the shutter is not normally opened.

First Embodiment

Figure 1:
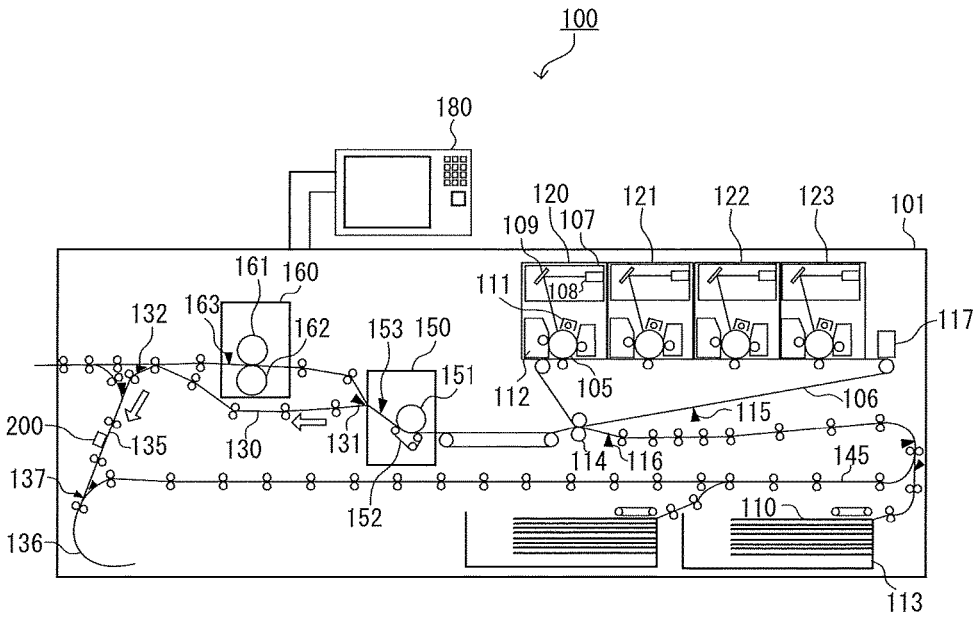
FIG. 1 is a schematic longitudinal sectional view illustrating an example of a configuration of an image forming apparatus according to a first embodiment.

FIG. 1 is a schematic longitudinal sectional view illustrating an example of a configuration of an image forming apparatus according to the present embodiment. An image forming apparatus 100 comprises a housing body 101 and an operation panel 180. In the housing body 101, various mechanisms which constitute an image forming unit for forming an image are arranged. In the image forming unit, by scanning laser light on an image bearing member of a photosensitive drum 105, an electrostatic latent image is formed. Then, the electrostatic latent image is developed. To perform multiple transfer of the developed image to an intermediate transfer body 106 to further transfer a color image having performed multiple transfer to a recording medium such as a sheet (hereinafter referred to as transfer member) 110, a transfer processing mechanism is arranged. Also, a fixing processing mechanism for fixing the toner image having transferred to the transfer member 110, a sheet feeding processing mechanism for the transfer member 110, a conveyance processing mechanism for the transfer member 110 etc. are arranged.

The image forming apparatus 100 also comprises respective laser scanner units 107 which correspond to each color of yellow (Y), magenta (M), cyan (C), and black (K). The laser scanner unit 107 comprises a laser driver which turns ON/OFF the laser light emitted from a semiconductor laser emitting device (not shown). For example, when the laser scanner unit 107 receives an image signal (image data) with its image resolution being, for example, 2400 [dpi] from a controller 300 (described later), the laser scanner unit 107 accordingly turns ON/OFF the laser light as mentioned. The laser light emitted from the semiconductor laser emitting device is distributed in a scanning direction through a rotating polygon mirror (not shown). The laser light distributed in a main scanning direction is guided to the photosensitive drum 105 through a reflection mirror 109 to expose a surface of the photosensitive drum 105.

On the other hand, by charging the photosensitive drum 105 by a primary charger 111 and by scanning exposure of the laser light, the electrostatic latent image is formed on the photosensitive drum 105. The electrostatic latent image then is developed into a toner image by toner supplied from a developing device 112 (described later). Then, the toner image developed on the photosensitive drum 105 is transferred on the intermediate transfer body 106 to which a voltage of reverse characteristic to the toner image is applied (primary transfer). As mentioned, the photosensitive drum 105 carries and conveys the image formed by the image forming unit. It is noted that, when forming the color image, respective colors are formed in order on the intermediate transfer body 106 from a yellow (Y) station 120, a magenta (M) station 121, a cyan (C) station 122, and a black (K) station 123. Thereby, a full color visible image is formed on the intermediate transfer body 106.

The full color visible image formed on the intermediate transfer body 106 is transferred to the transfer member 110 fed from a storage 113 of the transfer member. In particular, the transfer member 110 is brought into pressure contact with the intermediate transfer body 106 by the transfer roller 114. Then, a voltage of reverse characteristic to the toner is applied to the transfer roller 114. In this manner, the visible image is transferred to the transfer member 110 which is synchronized and fed in a sub-scanning direction by a sheet feeding processing mechanism (secondary transfer). It is noted that the photosensitive drum 105 and the developing device 112 are attachable/detachable to/from the image forming apparatus 100.

Also, a start position detection sensor 115 and a sheet feeding timing sensor 116 are arranged around the intermediate transfer body 106. The start position detection sensor 115 determines a print start position when performing image formation. The sheet feeding timing sensor 116 is used to control sheet feeding timing of transfer member 110. A density detection sensor 117 is also arranged. The density detection sensor 117 is used to measure the density of the patch image (measurement image) for a density correction when controlling the density. It is noted that, based on the detection result of the density detection sensor 117 (measured data), stabilization control (described later) is executed. Also, the detail of the density detection sensor 117 is described later.

The fixing processing mechanism comprises a first fixing unit 150 and a second fixing unit 160 for fixing the toner image transferred to the transfer member 110 by heat and pressure. The first fixing unit 150 comprises a fixing roller 151 for applying heat to the transfer member 110, a pressurizing belt 152 for bringing the transfer member 110 into pressure contact with the fixing roller 151, and a post-fixing sensor 153 for detecting completion of fixation. Each roller is a hollow roller, respectively having a heater inside, and is configured to convey the transfer member 110 at the same time each roller is rotationally driven. The second fixing unit 160 is positioned downstream of the conveyance path of the transfer member 110 as compared to the first fixing unit 150. The second fixing unit 160 adds gloss and secures fixability to the toner image fixed on the transfer member 110 by the first fixing unit 150. Similar to the first fixing unit 150, the second fixing unit 160 also comprises a fixing roller 161, a pressurizing roller 162, and a post-fixing sensor 163.

It is noted that some sheets are not required to go through the second fixing unit 160 depending on a type of the transfer member 110. In this case, to reduce energy consumption, the transfer member 110 is guided to a conveyance path 130 through a conveyance path switching flapper 153 to discharge the transfer member 110 not via the second fixing unit 160.

The transfer member 110 is guided to a conveyance path 135 through a conveyance path switching flapper 132. Then, after the position of the transfer member 110 is detected by a reverse sensor 137, switchback operation is performed to the transfer member 110 at a reverse section 136. Then, a preceding edge of the transfer member 110 is changed. A color sensor 200 is a color sensor for detecting the measurement image formed on the transfer member 110. In a case where a color detection operation is instructed through the operation panel 180, density adjustment, gradation adjustment, multi-color adjustment, etc., are performed based on the detection result of the color sensor 200. It is noted that controls concerning the image forming processing performed by each mechanism (for example, sheet feeding processing) are performed through an image forming control unit 102 (described later).

[Operation Panel]

Figure 2:
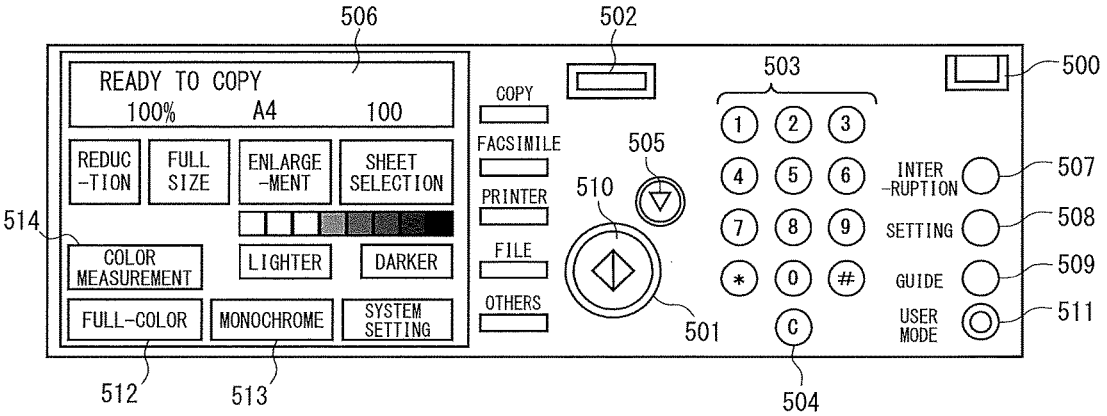
FIG. 2 is a partial enlarged view of a display screen of an operation panel.

FIG. 2 is a partial enlarged view of a display screen of the operation panel 180. A soft switch 500 displayed on the display screen is a button for turning ON/OFF a power source of the image forming apparatus 100 main body. A copy start key 501 is a button for instructing to start copying. A reset key 502 is a button used to back an image forming mode of the image forming apparatus 100 to a normal mode. Here, in the normal mode, "full color: single side" image is set to be formed. A numeric keypad 503 is a keypad used to input a numeric value such as the number of image forming sheets. A clear key 504 is a button used to clear the numeric value input. A stop key 505 is a button used to stop copying during continuous copying.

A touch panel 506 displays the setting of various modes and a state of a printer. Also, it receives an input through touch operation. An interruption key 507 is a button used to interrupt during the continuous copying or while using the image forming apparatus 100 as a facsimile machine or a printer to execute other operations. A password key 508 is a button used to manage the number of copies individually or sectorally. A guidance key 509 is a button pressed down when using a guidance function.

A function key 510 is a key used when changing a function of the image forming apparatus 100. A user mode key 511 is a button used to switch to a mode that is managed and set by a user. In particular, the user mode key is used when the user adjusts sensitivity of the sensor, performs a calibration mode of density and color, registers sheets, and changes setting time until the image forming apparatus 100 enters an energy saving mode. A color measuring mode 414 is a button used to switch the image forming apparatus 100 to a color measuring mode.

Also, a full color mode key 512 is a button selected when forming the full color image. A monochrome mode key 513 is a button selected when forming a monochrome image (or single color image). In the following description, selection and execution of pseudo halftone processing pattern (hereinafter referred to as pseudo halftone processing) etc. are instructed through, for example, the operation panel 180.

[Image Processing Unit]

Figure 3:
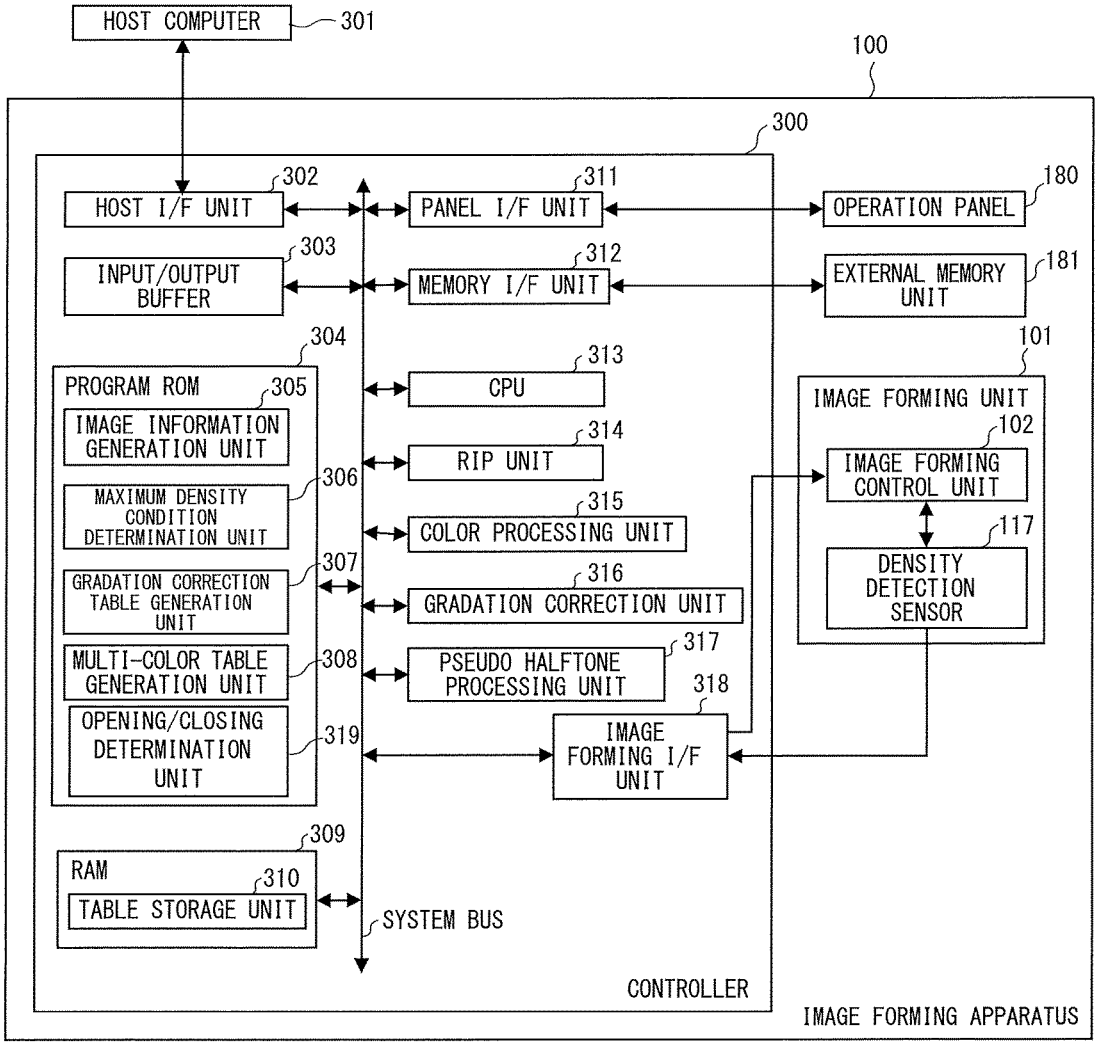
FIG. 3 is a block diagram for explaining an example of functional configuration of the image forming apparatus.

FIG. 3 is a block diagram for explaining an example of functional configuration of the image forming apparatus 100. The image forming apparatus shown in FIG. 3 is connected to a host computer 301 via a communication line such as a network (for example, in compliance with 10base-T, IEEE 802.3).

The controller 300 controls an operation of the image forming apparatus 100. Also, the controller 300 comprises a host I/F unit 302, an input/output buffer 303, a read only memory (ROM) 304, and an image information generation unit 305. The controller 300 also comprises a maximum density condition determination unit (Vcont: development contrast potential) 306, a gradation correction table generation unit (gamma LUT: gamma look up table) 307, and a multi-dimensional table generation unit (ICC profile) 308. The controller 300 also comprises a random access memory (RAM) 309, a central processing unit (CPU) 313, a raster image processor (RIP) unit 314, a color processing unit 315, a gradation correction unit 316, a pseudo halftone processing unit 317, an image forming I/F unit 318, and an opening/closing determination unit 319 which determines opening/closing of a shutter 407, which is described later. Each functional configuration is connected to allow transmission and reception of various information through a system bus.

The host I/F unit 302 is an interface for transmission and reception of information to and from the host computer 301. The input/output buffer 303 transmits and receives a control code from the host I/F unit 302 and data from each communication means. The CPU 313 controls the entire operation of the controller 300. Control programs executed by the CPU 313 and various control data are stored in the ROM 304. The RAM 309 is used as a work memory for performing calculation required to translate the control code and data or processing of print data. The image information generation unit 305 generates various image objects based on the data received from the host computer 301.

The RIP unit 314 develops the image object into a bit map image. The color processing unit 315 performs multi-color color conversion processing (described later). The gradation correction unit 316 executes single color gradation correction. The pseudo halftone processing unit 317 executes the pseudo halftone processing which is referred to as dither matrixes, error diffusion method etc. The image forming I/F unit 318 transfers the converted image to the image forming unit. In this manner, the image is formed. Also, in the image forming apparatus 100, for example, two types of the pseudo halftone processing pattern can be executed. The image forming apparatus 100 separately forms the measurement image for density correction in one or more pseudo halftone processing. Also, the image forming apparatus 100 can form the measurement image of one or more colors separately. Then, based on the detection result, through which the density of the measurement image is detected, image adjustment is performed, which is to optimize the maximum density condition and the gradation correction table.

The maximum density determination unit 306 determines the maximum density correction condition to adjust the maximum density. The gradation correction table generation unit 307 determines the gradation correction coefficient based on the maximum density correction condition determined. To correct the variation of the multi-color, the multi-color table generation unit 308 generates ICC profile, which is multi-dimension LUT. It is noted that each adjustment result in the maximum density condition determination unit 306, the gradation correction table generation unit 307, and the multi-color table generation unit 308 is primarily stored in the table storage unit 310 in the RAM 309.

A panel I/F unit 311 mediates transmission and reception of information between the controller 300 and the operation panel 180. A memory I/F unit 312 mediates transmission and reception of information between the controller 300 and an external memory unit 181 which is used to store print data, information of various print devices etc. It is noted that each of the image information generation unit 305, the maximum density condition determination unit 306, the gradation correction table generation unit 307, and the multi-color table generation unit 308 in which the correction result of the multi-color is reflected are stored in the ROM 304 as a function module.

Also, information of the ICC profile, the gamma LUT, and the Vcont used at the time of forming the image is appropriately managed and updated. It is noted that the feature of the present disclosure, i.e., change of the exposure condition between the sheets (an interval between a preceding sheet and the following sheet) is determined by the maximum density condition determination unit 306 as mentioned. Then, the determination result is notified to the image forming control unit 102. The exposure condition is changed (reflected) before printing the measurement image in the first pseudo halftone processing (described later).

Based on the detection result (measured data) of the density detection sensor 117, the opening/closing determination unit 319 determines whether the shutter 407 is in an opened state or in a closed state. The determination result is notified to the CPU 313. The CPU 313 determines whether to perform the correction or not in accordance with the determination result received and notifies the gradation correction table generation unit 307 of the determination result. If it is determined that the shutter 407 is in the closed state, the CPU 313 controls not to update the gradation correction table. In this manner, the controller 300 functions as an image adjustment unit which changes the image forming condition.

[Outline of Density Detection Sensor]

Figure 4A:
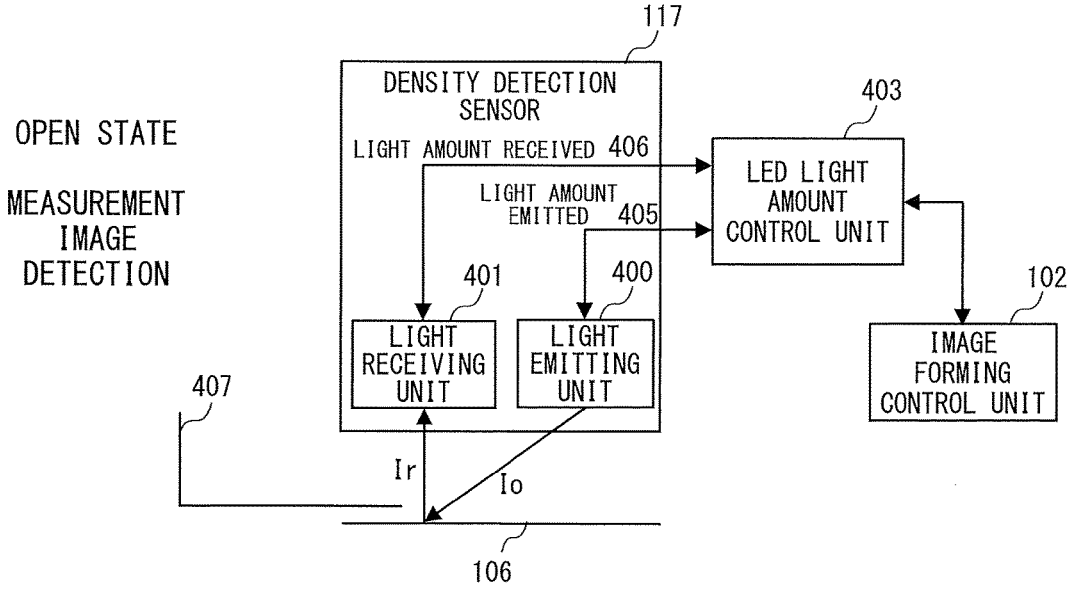
FIGS. 4A and 4B are diagrams for explaining stabilization control in the image forming apparatus.
Figure 4B:
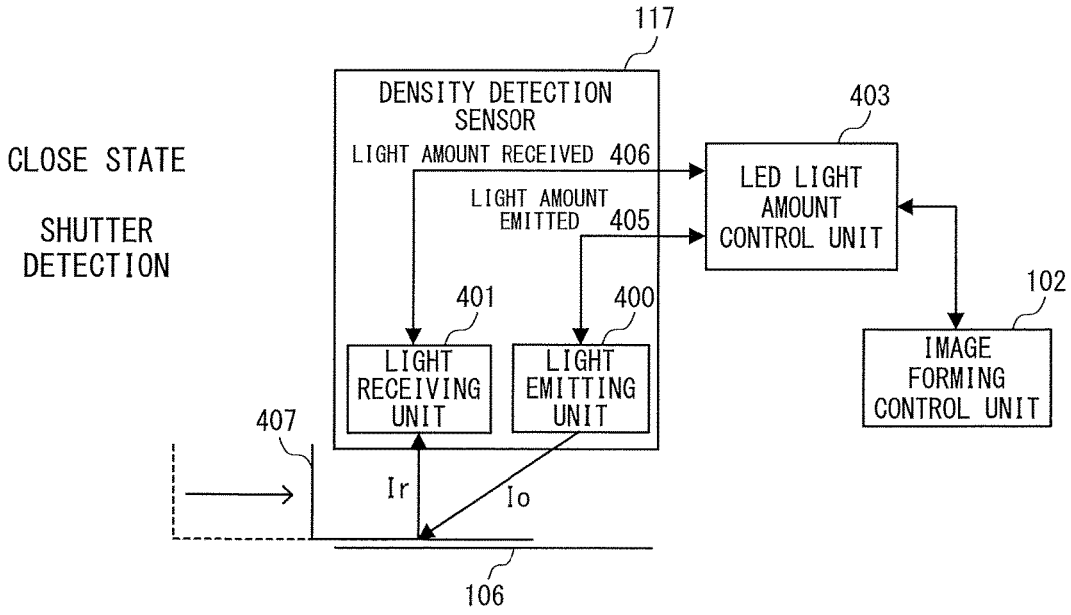

FIGS. 4A and 4B are diagrams for explaining stabilization control in the image forming apparatus 100. FIG. 4A represents a shutter open state. FIG. 4B represents a shutter closed state. Detail of the shutter open state and the shutter closed state is described later with FIG. 6.

The density detection sensor 117 comprises a light emitting unit 400 and a light receiving unit 401. Light Io emitted from the light emitting unit 400 is reflected on the surface of the intermediate transfer body. Then, the reflected light Ir is measured at the light receiving unit 401. The reflected light measured at the light receiving unit 401 is monitored at an LED light amount control unit 403. The monitored result is then sent to the image forming control unit 102. The image forming control unit 102 calculates the density based on the light source light Io and the measured value of the reflected light Ir. For example, the measured value of the output value, 0 to 5 [V], is standardized into a digital signal value of 0 to 1023 levels. Then, the density is calculated. In this manner, the density detection sensor 117 can detect the density of an object to be detected on an optical path including the measurement image.

As shown in FIG. 4A, a state in which the density detection sensor 117 can measure the measurement image on the intermediate transfer body 106 is the shutter open state. Further, as shown in FIG. 4B, a state in which the density detection sensor 117 can measure a surface of the shutter 407 is the shutter closed state. It is noted that the shutter 407, lying between the density detection sensor 117 and the intermediate transfer body 106, is provided on the optical path between the density detection sensor 117 and the measurement image.

Figure 5:
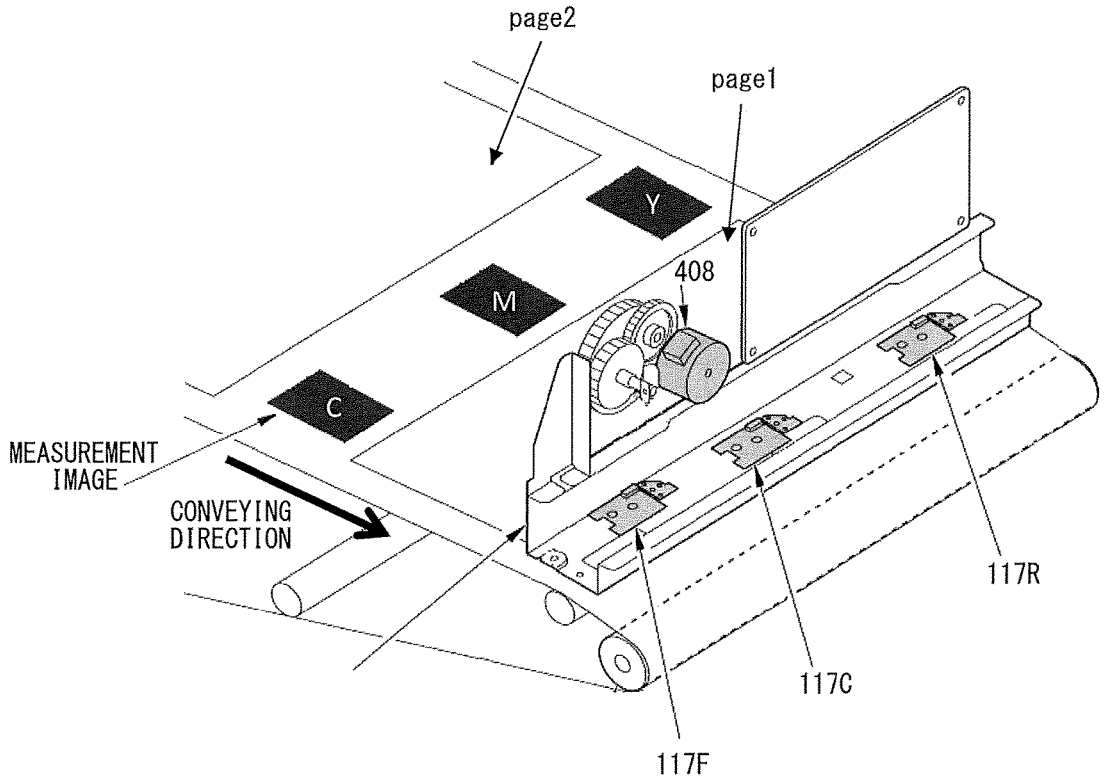
FIG. 5 is a diagram schematically representing a state in which density of the measurement image formed between sheets is detected.

FIG. 5 is a diagram schematically representing a state in which the density detection sensor 117 detects the measurement image formed between the sheets. As shown in FIG. 5, three measurement images corresponding to each color of cyan, magenta, and yellow are formed between the sheets of normal images page 1 and page 2 formed on the intermediate transfer body 106. The density detection sensor 117 can also measure the density of one or more colors separately. As shown in FIG. 5, the density detection sensor 117 comprises a density detection sensor 117F for detecting the measurement image of cyan, a density detection sensor 117C for detecting the measurement image of magenta, and a density detection sensor 117R for detecting the measurement image of yellow. For example, in the shutter closed state, the detecting surfaces of the density detection sensor 117F and the density detection sensor 117C are covered. Each sensor is arranged in a direction orthogonal to a conveying direction and at different positions. Further, through an adjustment of the light amount of the density detection sensor of each color, intensity of the emitted light is adjusted such that, when the light is emitted to a rear side of the shutter 407 when the power is ON before forming the image, an output value reaches a target value. The target value corresponds to the output value of a "shutter rear side" described in Tables 1 to 3 described later. Further, the respective target values of the density detection sensors 117F, 117C, and 117R are previously determined by an experiment. Due to an attachment error etc. of the shutter 407, the target value of each density detection sensor may differ. A motor 408 is a driving source used to open/close the shutter 407 and functions as an opening/closing mechanism of the shutter 407. Note that, as to Bk (black), the correction timing is separately provided for correction.

[Configuration of Shutter]

Figure 6A:
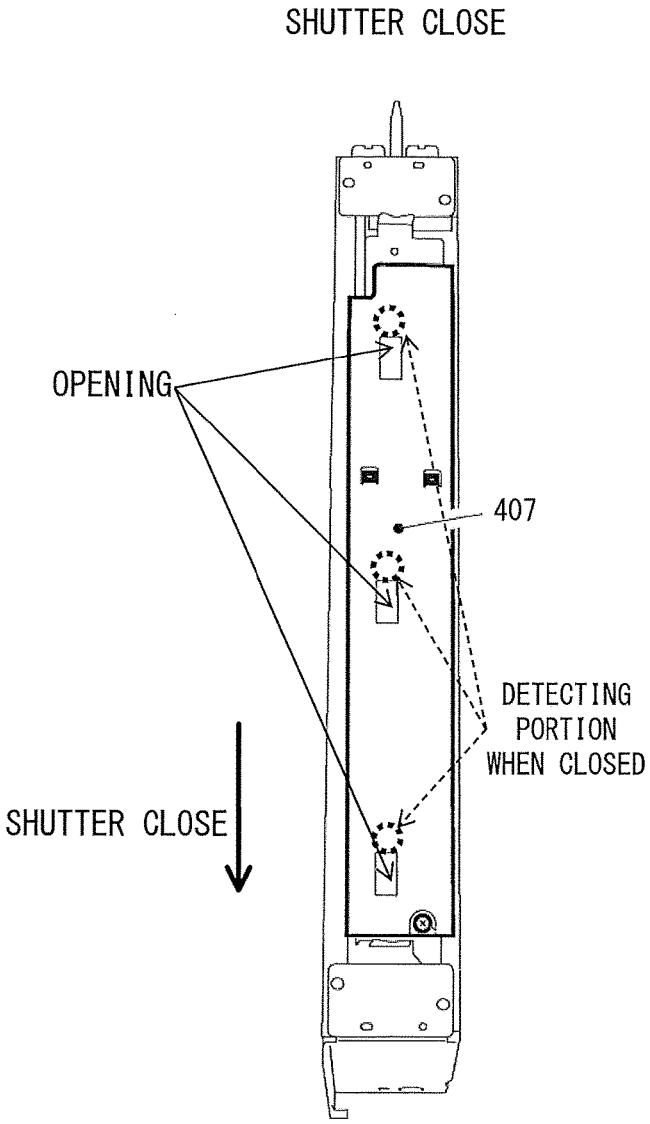
FIGS. 6A and 6B are schematic diagrams of a unit comprising a shutter and a density detection sensor which is viewed from an intermediate transfer body side.
Figure 6B:
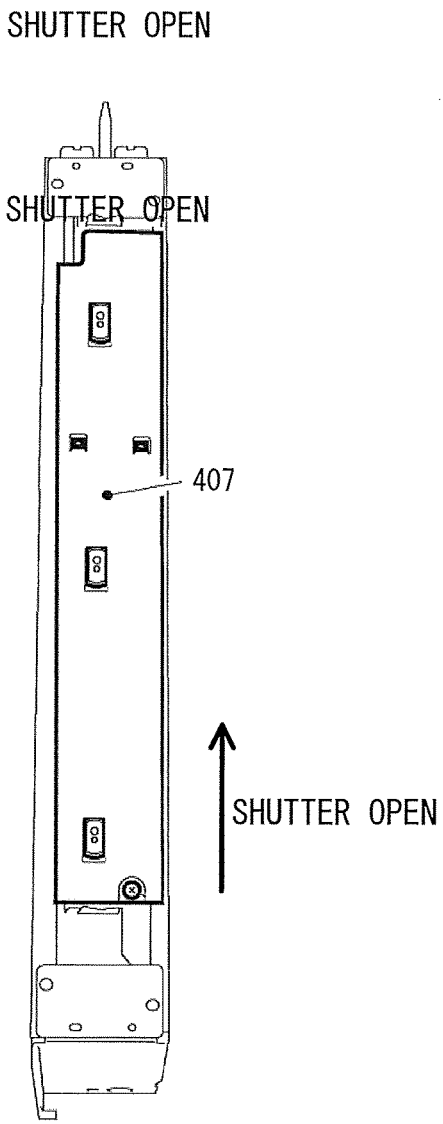

FIGS. 6A and 6B are schematic diagrams when a unit comprising the shutter 407 and the density detection sensor 117 shown in FIGS. 4A and 4B are viewed from the intermediate transfer body side. FIG. 6A shows the shutter closed state in which the shutter 407 is moved to a first position. FIG. 6B shows the shutter open state in which the shutter 407 is moved to a second position. For example, the shutter 407 is comprised of one metal plate. Three openings are provided on a surface of the metal plate. Further, the shutter 407 is provided to be relatively slidable with respect to the density detection sensor 117 and is integrally movable to the first position and to the second position by a driving force of the motor 408. Further, before one pair of the measurement images passes a measurement position, the shutter 407 is moved to the first position from the second position. As shown in FIG. 6A, in the shutter closed state, the density detection sensor 117 detects positions around the dotted line in FIG. 6A. Further, as shown in FIG. 6B, in the shutter open state, the position of the detecting surface of the density detection sensor 117 matches with the position of the shutter opening so that the detecting surface is opened. As a result, detection of one or more measurement images formed on the intermediate transfer body becomes possible. To prevent stains of the detecting surface of the density detection sensor 117 due to the scattering toner, etc., the shutter 407 is closed when the measurement image is not detected.

[Outline of Stabilization Control]

The density detection sensor 117 is used for the stabilization control for obtaining correct color tone in a recorded image. It means that the measurement image experimentally formed (printed) on the intermediate transfer body is detected through the density detection sensor 117. It is noted that the stabilization control includes, for example, "Dmax control" and "halftone control".

In the Dmax control, exposure amount is made variable and an image formed using developer (hereinafter referred to as "developer image") is experimentally formed. Then, the density of the developer image is measured to calculate the exposure amount corresponding to the target density of each color. Further, in the halftone control, developing images of different stages, formed with the exposure amount calculated by the Dmax control and having experienced half-toning such as screening are experimentally formed. The developing image is measured and a table (a gamma LUT), in which an input/output relation is corrected such that an output result for an input signal becomes target density characteristic, is formed. The gamma LUT is stored in the gradation correction unit 316 to wait for the next image formation. The image forming apparatus 100 prints and detects the measurement image to which one or more pseudo halftone processing have been applied between the sheets which are in continuous output. Then, to change the maximum density condition based on the detection result, the image forming apparatus 100 changes the exposure amount and the value of the gamma LUT. This is described in detail in the following.

Figure 7:
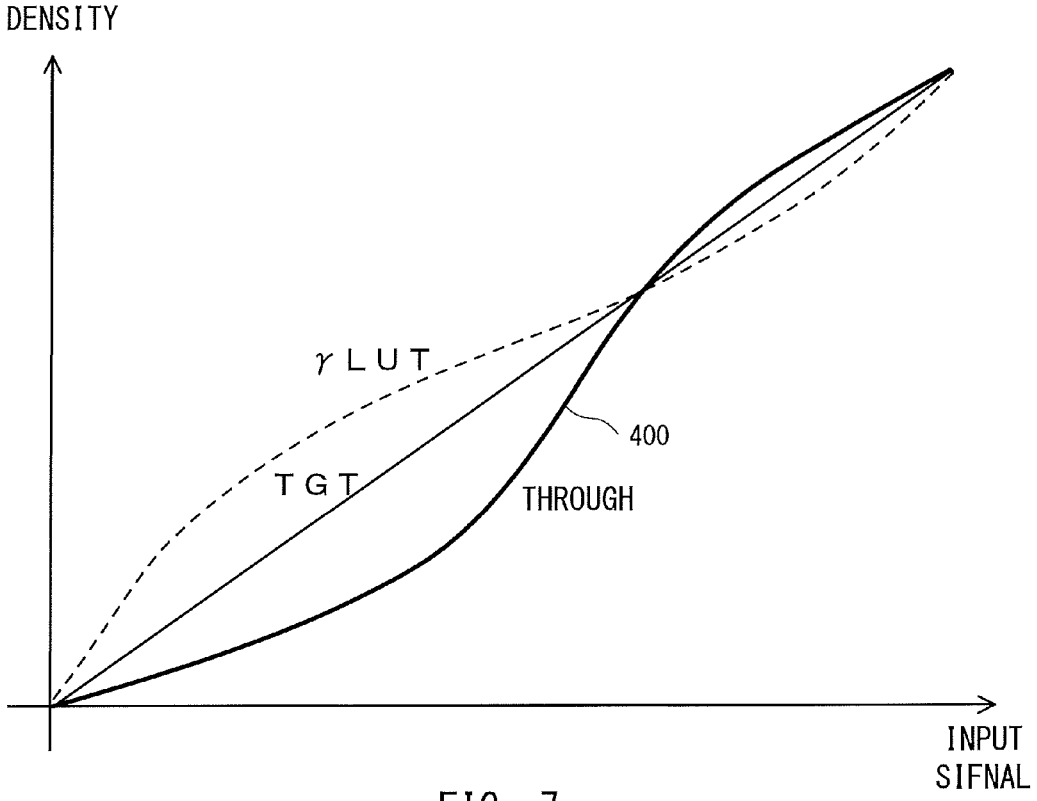
FIG. 7 is a graph for explaining gradation characteristic.

FIG. 7 is a graph for explaining gradation characteristic. The solid line in FIG. 7 represents the gradation characteristic. Further, the solid line TGT represents one example of an ideal gradation characteristic. To have a density corresponding to the value of the input signal included in the image data, the value of the input signal is converted. The conversion is performed using conversion condition (gradation correction condition) represented by the dotted line in FIG. 7. The gamma LUT is a table for correcting the input/output relation such that the output result for the input signal becomes the target density characteristic. The gamma LUT is stored in the gradation correction unit 316 to wait for the next image formation.

Figure 8:
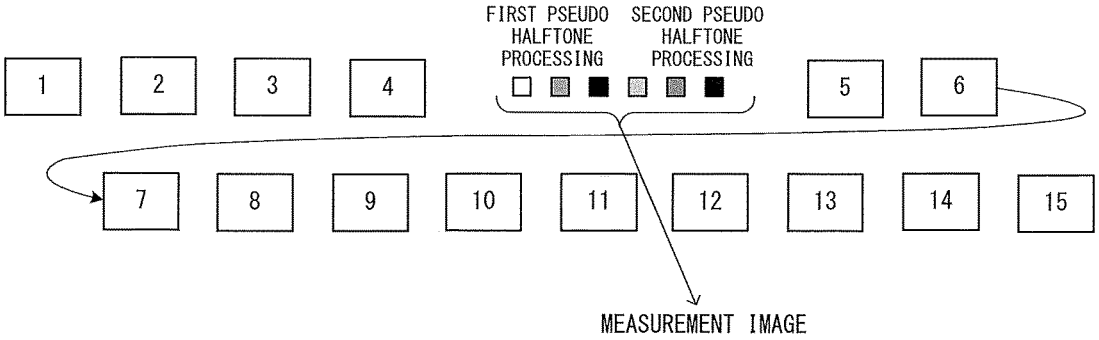
FIG. 8 is a diagram for explaining forming timing of the measurement image formed by the image forming apparatus between sheets.

FIG. 8 is a diagram for explaining forming timing of the measurement image formed between the sheets by the image forming apparatus. In FIG. 8, numbers (1 to 15) enclosed in a rectangular shape respectively represent the normal images page 1 to page 15. Further, as shown in FIG. 8, the measurement image of the first pseudo halftone processing (170 [lpi]) and the measurement image of a second pseudo halftone processing (230 [lpi]) are formed between the sheets of the normal images page 4 and page 5 which are in continuous output.

Figure 9:
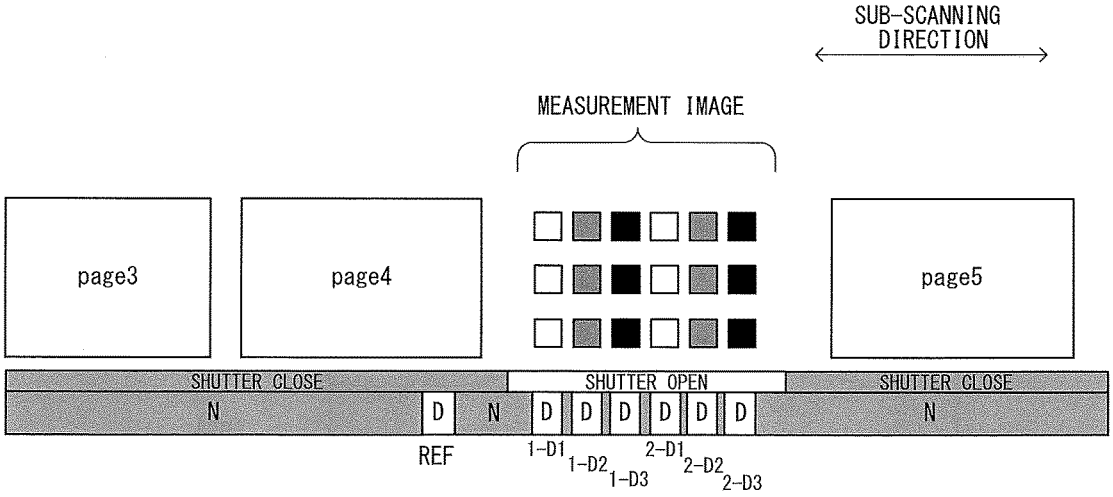
FIG. 9 is a diagram for explaining a relation of opening/closing state of the shutter and detection/non-detection of the density detection sensor with respect to the measurement image.

FIG. 9 is a diagram for explaining the relation of opening/closing state of the shutter 407 and detection/non-detection of the density detection sensor 117 with respect to the measurement image. For example, the density detection sensor 117 performs detection in the normal image page 4 which is before detecting the measurement image formed on the intermediate transfer body. In this case, the shutter is in the closed state so that, as shown in FIG. 9, the density detection sensor 117 detects the surface of the shutter 407. In FIG. 9, for simplification, "detection" is represented as "D", and "non-detection" is represented as "N". It is noted that the surface of the shutter 407 detected by the density detection sensor 117 is expressed as a shutter rear side. The detection result of the shutter rear side detected by the density detection sensor 117 is expressed as ref (reference measured data). Further, the shutter 407 is opened between the sheets of the normal images page 4 and page 5. The measurement images of one or more density levels are detected therebetween. After the detection, the shutter 407 is in the closed state again. Next, a description is provided with regard to a method to determine whether there is opening/closing abnormality of the shutter 407 or not.

[Determination of Opening/Closing Abnormality of Shutter]

Table 1 below shows one example of what is detected at the detection timing as described in FIG. 9. In Table 1, the detection result of the shutter rear side by the density detection sensor 117 is expressed as Ref. Each of the letters C, M, Y represents color. In particular, C represents cyan, M represents magenta, and Y represents yellow. Each of the numbers placed after the letters represents the pseudo halftone processing. Further, in Table 1, D1 represents the detection in a low density area of the measurement image, D2 represents the detection in a medium density area of the measurement image, and D3 represents the detection in a high density area of the measurement image.

TABLE 1

| | SENSOR 117F | SENSOR 117C | SENSOR 117R |
|---|---|---|---|
| Correction Color | Cyan | Magenta | Yellow |
| Shutter Rear Side | C-ref | M-ref | Y-ref |
| 170 lpi Low density | C1-D1 | M1-D1 | Y1-D1 |
| 170 lpi Medium density | C1-D2 | M1-D2 | Y1-D2 |
| 170 lpi High density | C1-D3 | M1-D3 | Y1-D3 |
| 230 lpi Low density | C2-D1 | M2-D1 | Y2-D1 |
| 230 lpi Medium density | C2-D2 | M2-D2 | Y2-D2 |
| 230 lpi High density | C2-D3 | M2-D3 | Y2-D3 |

The detection characteristic shown in Table 2 as below is obtained if the shutter 407 is normally operated in the regulated opening/closing operation at the timing shown in FIG. 9.

TABLE 2

| | SENSOR 117F | SENSOR 117C | SENSOR 117R |
|---|---|---|---|
| Correction Color | Cyan | Magenta | Yellow |
| Shutter Rear Side | 540 | 520 | 505 |
| 170 lpi Low density | 101 | 90 | 96 |

TABLE 2-continued

| | SENSOR 117F | SENSOR 117C | SENSOR 117R |
|---|---|---|---|
| 170 lpi Medium density | 389 | 420 | 442 |
| 170 lpi High density | 700 | 705 | 698 |
| 230 lpi Low density | 105 | 93 | 97 |
| 230 lpi Medium density | 400 | 433 | 462 |
| 230 lpi High density | 702 | 708 | 701 |

On the other hand, the detection characteristic shown in Table 3 as below is obtained as the detection result of the density detection sensor if abnormality occurs and the shutter 407 is not normally operated, including the case, for example, where the shutter 407 is not turned into the open state. In this case, the value of the detection result of the density detection sensor is almost equal to the value of the detection result of the shutter rear side.

TABLE 3

| | SENSOR 117F | SENSOR 117C | SENSOR 117R |
|---|---|---|---|
| Correction Color | Cyan | Magenta | Yellow |
| Shutter Rear Side | 540 | 520 | 505 |
| 170 lpi Low density | 541 | 521 | 503 |
| 170 lpi Medium density | 540 | 520 | 504 |
| 170 lpi High density | 542 | 520 | 505 |
| 230 lpi Low density | 541 | 522 | 506 |
| 230 lpi Medium density | 539 | 521 | 505 |
| 230 lpi High density | 540 | 519 | 504 |

Based on these detection characteristics, the CPU 313 performs arithmetic operations 1 and 2 as shown below through the opening/closing determination unit 319 to determine whether the shutter 407 is in the open state or in the closed state. The CPU 313 compares the detection result of each measurement image with Ref and calculates the difference therebetween. Then, the CPU 313 determines whether the difference which is at a predetermined reference value or below (for example, Δ±2 level or below) is included in the comparison result or not. If the difference which is Δ±2 level or below is included in the comparison result, the CPU 313 also determines whether the differences of the rest of the colors obtained by the comparison are Δ±2 level or below or not. If it is determined that all the differences of the rest of the colors obtained by the comparison are Δ±2 level or below, the CPU 313 determines that the shutter is in the closed state (arithmetic operation 2).

In this manner, if all the detection results of one or more density detection sensors are almost the same value as the value of the detection result of the shutter rear side, the CPU 313 determines that the shutter is in the closed state. This is because, as shown in Table 3, the detection result of the rear side color is almost equal to the detection results in the low density to high density areas, which causes difficulty in distinguishing from the normal state. It means that when determining whether the shutter 407 is in the open state or in the closed state based only on the detection result of the density detection sensor of one color, in many cases, the density adjustment is unnecessarily stopped. Thereby, in the image forming apparatus 100 according to the present embodiment, using the detection result which detected the measurement image formed at almost the same timing in a sub-scanning direction, the open/closed state of the shutter 407 is determined. Then, if it is determined that the shutter 407 is in the closed state based on the calculation result, the CPU 313 controls not to update the gradation correction table to stop to change the image forming condition.

[Processing Procedure of Gradation Correction]

Figure 10:
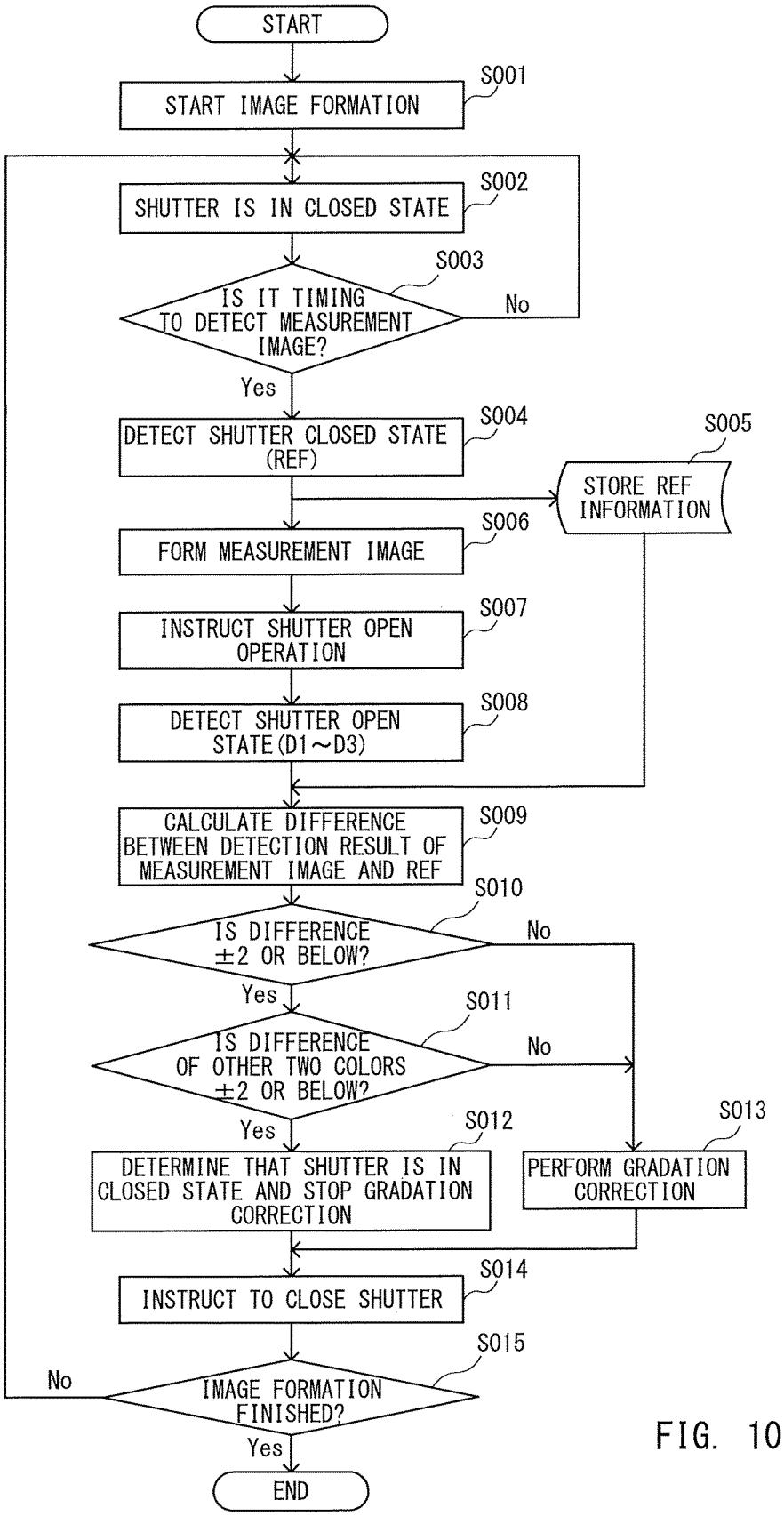
FIG. 10 is a flowchart illustrating an example of processing procedure of a gradation correction of the image forming apparatus.

FIG. 10 is a flowchart illustrating one example of a processing procedure of the gradation correction of the image forming apparatus 100. Each processing shown in FIG. 10 is mainly performed by the CPU 313. When receiving a print instruction from a user, the CPU 313 starts to form an image (S001). The CPU 313 confirms that the shutter 407 is in the closed state (S002). This restricts contamination of the detecting surface of the density detection sensor 117 due to scattering toner.

The CPU 313 determines whether it is time to start density detection previously set or not (S003). If it is determined that it is time to start the density detection (S003: Y), before starting to form the measurement image, the CPU 313 performs the density detection in the shutter closed state (S004). Then, the CPU 313 temporarily stores the detection result Ref in the shutter closed state in an external memory unit 181 (S005). If not (S003: N), the CPU 313 goes back to the processing of Step S002.

The CPU 313 forms one or more measurement images between the sheets (S006) and turns the shutter 407 into the open state (S007). The CPU 313 instructs each density detection sensor (117F, 117C, 117R) to start detection. Then, the CPU 313 obtains the detection result of each color separately (S008). The CPU 313 compares the detection result Ref obtained in the processing of Step S004 with the detection result obtained in the processing of Step S008. Then, based on the comparison result, the CPU 313 calculates the difference therebetween (S009).

The CPU 313 determines whether a color having the difference which is Δ±2 or below is included in the comparison result or not (S010). If it is determined that no color having the difference which is Δ±2 or below is included in the comparison result (S010: N), the CPU 313 performs the gradation correction processing (S013). If not (S010: Y), the CPU 313 also determines whether the difference of the rest of the colors obtained by the comparison is Δ±2 or below or not (S011). If it is determined that no color having the difference which is Δ±2 or below is included in the comparison result of the rest of the colors (S011: N), the CPU 313 performs the gradation correction processing (S013).

If not (S011: Y), the CPU 313 determines that the shutter 407 is in the closed state when detecting the measurement image by each density detection sensor. Then, the CPU 313 stops the gradation correction processing (S012). The CPU 313 turns the shutter 407 into the closed state (S014). Thereafter, the CPU 313 determines whether a series of the image formation is finished or not (S015). If the image formation is not finished, the CPU 313 goes back to the processing of the step S002.

In this manner, the image forming apparatus 100 of the present embodiment can detect the opening/closing abnormality of the shutter 407 using the density detection sensor 117 used for the gradation correction. It means that, without a dedicated shutter opening/closing sensor, the gradation characteristic (gamma LUT) of the apparatus can be controlled with high accuracy. This allows restriction of occurrence of a defect (tone jump) when performing the gradation correction. In addition, an image forming apparatus with low cost and high stability can be provided. It is noted that, in the above, the description has been provided for the case where the reference value of the difference based on the comparison result is ±2. A maximum output voltage of the sensor, 5[V], is converted to a digital signal value of 1023 level. The digital signal value is adjusted such that maximum density region becomes 700, 0.3[%] of which is the reference value of ±2.

Further, a sensor detection value, 0.3[%] in the specified maximum density is a value which should be changed depending on noise component of sensor or main body and bit number used when converting analog signals to digital signals, so it is not intended to limit the number to 0.3[%]. It is noted that, when determining whether the shutter 407 is closed or not, considering the fact that there are many cases where the gradation correction processing is stopped so that stability is impaired, it is desired that the value is set within about 1[%].

Further, in the above, the description of detecting a shutter member itself has been provided. As the shutter member, those with various materials and surface properties, from mold to plate, can be employed. In particular, by employing the shutter member with high uniformity of the shutter rear side or the shutter member to which toner is hardly adhered, occurrence of variation in the detection result when the shutter is in the closed state can be prevented. It is noted that, to prevent the occurrence of variation in the detection result detected when the shutter is in the closed state, a reference member, managed to satisfy predetermined standard such as uniformity, may be arranged at detecting portion of the shutter 407 and the density detection sensor may read the reference member.

Second Embodiment

In the present embodiment, a description is provided with regard to an image forming apparatus capable of separately forming one measurement image between the sheets and performing the gradation correction by integrating three measurement images. Note that the same symbols are used for the functional components which are identical to those as described in the first embodiment and the description thereof will be omitted.

Figure 11:
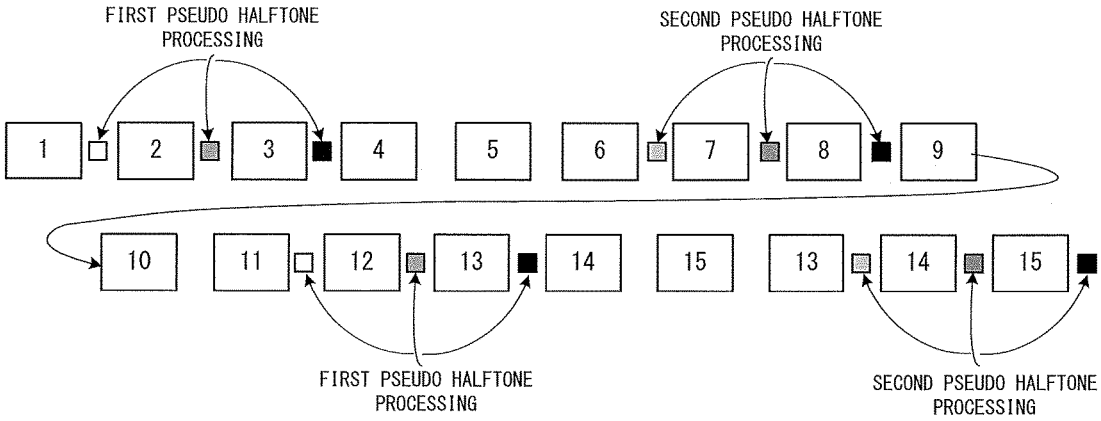
FIG. 11 is a diagram for explaining forming timing of the measurement image formed by the image forming apparatus according to a second embodiment between sheets.

FIG. 11 is a diagram for explaining forming timing of the measurement image formed by the image forming apparatus according to the present embodiment between the sheets. Numbers (1 to 15) enclosed in a rectangular shape respectively represent the normal images page 1 to page 15. As shown in FIG. 11, the image forming apparatus according to the present embodiment forms, for example, the measurement image of low density of the first pseudo halftone processing between the sheets of the normal images page 1 and page 2. Further, the image forming apparatus forms the measurement image of medium density of the first pseudo halftone processing between the sheets of the normal images page 2 and page 3. Further, the image forming apparatus forms the measurement image of high density of the first pseudo halftone processing between the sheets of the normal images page 3 and page 4. Then, the density detection sensor 117 detects the density of the three measurement images separately. Similarly, the image forming apparatus forms the measurement image of low density of the second pseudo halftone processing between the sheets of the normal images page 6 and page 7. Further, the image forming apparatus forms the measurement image of medium density of the second pseudo halftone processing between the sheets of the normal images page 7 and page 8. Further, the image forming apparatus forms the measurement image of high density of the second pseudo halftone processing between the sheets of the normal images page 8 and page 9. In this manner, the image forming apparatus repeatedly forms the images corresponding to each density separately from the end of the image formation to the start of the next image formation (between the sheets) to form the measurement image.

Then, the image forming apparatus performs the gradation correction of the first pseudo halftone processing (170 [lpi]) based on the detection results of the three measurement images formed between the normal images page 1 and page 2, page 2 and page 3, and page 3 and page 4. The image forming apparatus also performs the gradation correction of the second pseudo halftone processing (230 [lpi]) based on the detection results of the three measurement images formed between the normal images page 6 and page 7, page 7 and page 8, and page 8 and page 9.

Figure 12:
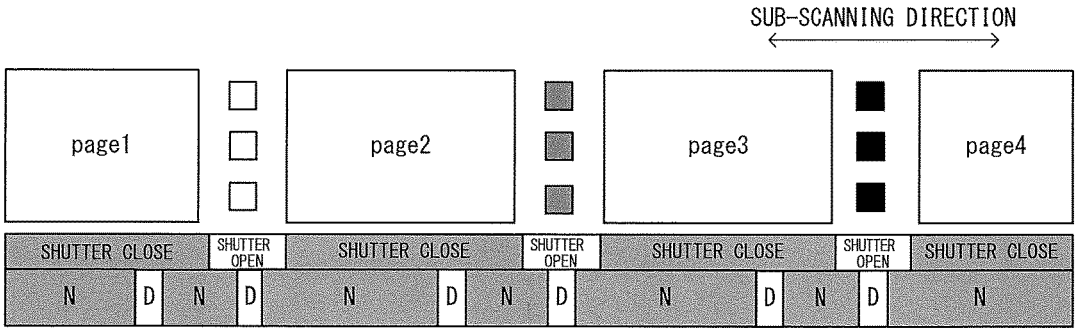
FIG. 12 is a diagram for explaining a relation of opening/closing state of the shutter and detection/non-detection of the density detection sensor with respect to the measurement image.

FIG. 12 is a diagram for explaining a relation of opening/closing state of the shutter 407 and detection/non-detection of the density detection sensor with respect to the measurement image. The density detection sensor 117 detects, for example, the shutter rear side in the normal image page 1, which is before detecting the measurement image formed on the intermediate transfer body. Then, the density detection sensor 117 detects the measurement image formed between the sheets of the normal images page 1 and page 2. Thereafter, the density detection sensor 117 again detects the shutter rear side in the normal image page 2. Then, the image forming apparatus according to the present embodiment determines the opening/closing state of the shutter 407 based on the difference between the detection result of each measurement image and Ref detected immediately before detecting each measurement image.

Here, there may be a case where, due to interference caused by adhesion of scattering objects such as toner on the surface of the shutter, driving member etc., malfunction is temporarily caused to the opening/closing operation of the shutter 407. For example, when abnormality occurs in the opening/closing operation of the shutter and none of the measurement images can be detected, while performing the opening/closing operation of the shutter, the abnormal state sometimes returns to the normal state due to vibration of the opening/closing operation of the shutter. The image forming apparatus of the present embodiment determines the opening/closing state of the shutter 407 for each measurement image formed between the sheets separately. Then, if it is determined that the shutter is in the closed state, the image forming apparatus controls to stop the gradation correction of the pseudo halftone processing corresponding to this. Further, in the pseudo halftone processing to be performed next, the opening/closing state of the shutter 407 is again determined.

In Table 4 as below, the difference between the detection result of the measurement image of low density and the detection result Ref of the shutter rear side is ±2 level or below. Also, the difference between the detection result of the measurement image of medium density and the detection result Ref of the shutter rear side is ±2 level or below. So, it is determined that the shutter 407 is in the closed state at the timing of detecting the measurement image. On the other hand, the shutter 407 is in the open state at the timing of detecting the measurement image of high density. So, it is determined that the operation state is returned to the normal state when the measurement image of high density is detected. In this case, among the three densities, low, medium, and high, two of them exceed the difference of ±2 level. Thereby, it is determined that the state is abnormal (NG). Thus, it is controlled not to perform the gradation correction in the pseudo halftone processing at this time.

TABLE 4

| | SENSOR 117F | SENSOR 117C | SENSOR 117R |
|---|---|---|---|
| Correction Color | Cyan | Magenta | Yellow |
| 170 lpi Shutter Rear Side Just before low density | 540 | 520 | 505 |
| 170 lpi Low density | 541 | 521 | 503 |
| Low density determination | NG | NG | NG |
| 170 lpi Shutter Rear Side Just before medium density | 540 | 520 | 504 |
| 170 lpi Medium density | 542 | 520 | 505 |
| Medium density determination | NG | NG | NG |
| 170 lpi Shutter Rear Side Just before high density | 541 | 521 | 505 |
| 170 lpi High density | 700 | 702 | 698 |
| High density determination | OK | OK | OK |
| Overall Determination | NG (when detecting low density and medium density, shutter was closed.) | | |

As mentioned, in the image forming apparatus according to the present embodiment, it is controlled not to perform the gradation correction processing when it is at least once determined that the shutter is in the closed state in the same pseudo halftone processing. For example, if, among the low density, medium density, and high density, the gradation correction emphasizing only the specific density is performed, it is considered to perform the gradation correction based on the detection result of the measurement image corresponding to the specific density. In this case, however, the detection result of the measurement image of the specific density and the detection result of the measurement image of other density largely vary, which may cause a correction level difference etc. Thereby, by performing the gradation correction processing like the image forming apparatus according to the present embodiment, occurrence of the correction level difference etc. can be restricted.

If it is continuously determined that the shutter is in the closed state as above, some abnormality may be caused to the apparatus. For example, a message like "density detection sensor shutter is in abnormal state. Please call a serviceman." may be displayed on the display screen of the touch panel 506 of the apparatus to prompt a user for requesting service. Further, the message can automatically be notified to a service station via network.

Third Embodiment

The descriptions have been provided in the first embodiment and the second embodiment for the case where the measurement images having different densities are formed in the sub-scanning direction. In this case, in the main scanning direction, the measurement images corresponding to each color having the same density are separately formed. When the detection result of the measurement image of medium density is close to the detection result Ref of the shutter rear side, sometimes, the opening/closing operation of the shutter 407 is wrongly determined. In the present embodiment, a description is provided with regard to the image forming apparatus which forms the measurement image having different densities in the main scanning direction. Note that the same symbols are used for the functional components which are identical to those as described in the first embodiment and the second embodiment and the description thereof will be omitted.

Figure 13:
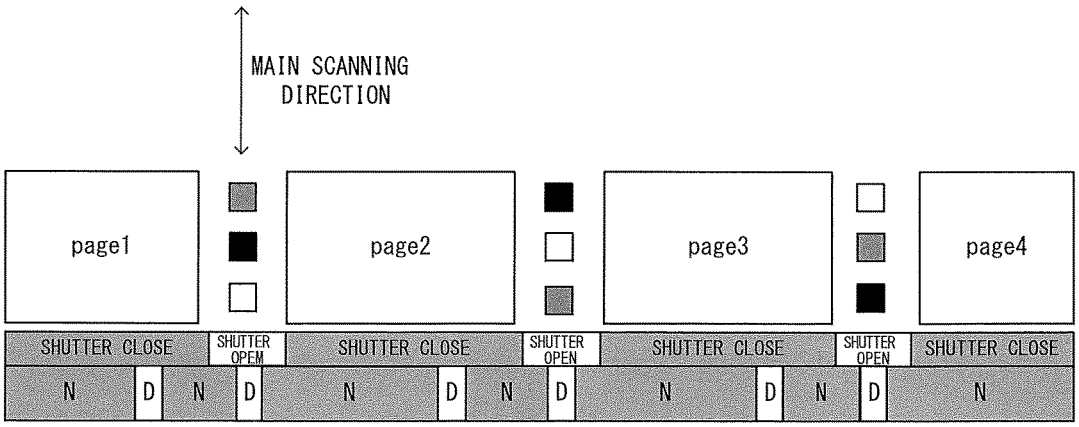
FIG. 13 is a diagram for explaining a relation of opening/closing state of the shutter and detection/non-detection of the density detection sensor with respect to the measurement image according to a third embodiment.

FIG. 13 is a diagram for explaining a relation of opening/closing state of the shutter 407 and detection/non-detection of the density detection sensor 117 with respect to the measurement image according to the present embodiment.

As shown in FIG. 13, the measurement images having different densities are formed in the main scanning direction. For example, as shown in Table 5 as below, the measurement images having different densities are separately formed for each color between the same sheets. Further, the measurement images are formed such that the densities of the neighboring measurement images in the sub-scanning direction are different from each other. In this case, in one detection, the measurement images having different densities are to be detected. Thereby, there causes large difference between the detection result Ref of the shutter rear side and the detection result of the measurement images of low density, medium density, or high density.

TABLE 5

| | SENSOR 117F | SENSOR 117C | SENSOR 117R |
|---|---|---|---|
| Correction Color | Cyan | Magenta | Yellow |
| First sheet interval | Low density | High density | Medium density |
| Second sheet interval | Medium density | Low density | High density |
| Third sheet interval | High density | Medium density | Low density |

As mentioned, in the image forming apparatus according to the present embodiment, the measurement images having different densities are separately formed for each color between the same sheets in the main scanning direction. This certainly prevents a situation where the shutter 407 is wrongly determined that it is in the closed state whereas actually it is in the open state.

Fourth Embodiment

For example, there is sometimes a case where causes problem in slidability of each part due to adhesion of scattering objects such as toner on the shutter 407. In this case, sometimes, the shutter 407 is half-opened (a half-opened state). In the present embodiment, a description is provided with regard to an image forming apparatus capable of coping with a case where so called half-opened state is caused. Note that, in the present embodiment, similar to the case of the third embodiment, the measurement images having different densities are formed in the main scanning direction. Further, the same symbols are used for the functional components which are identical to those as described in the first, second, and third embodiments and the description thereof will be omitted.

Figure 14:
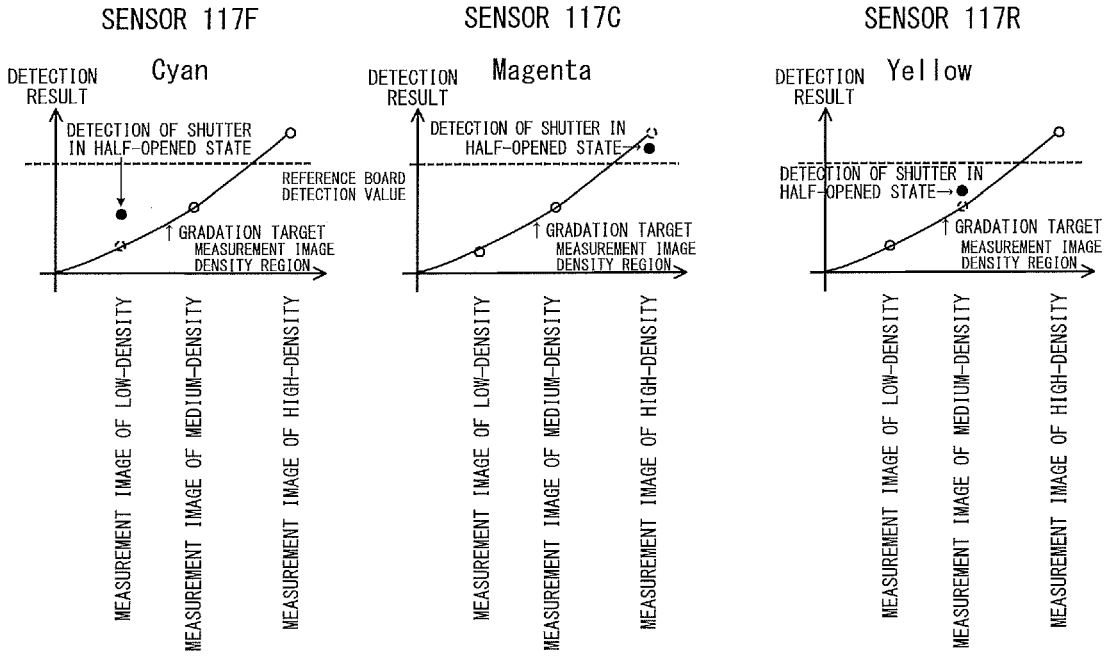
FIG. 14 is a graph for explaining detection of half-opened state of the shutter by the density detection sensor according to a fourth embodiment.

FIG. 14 is a graph for explaining detection of the half-opened state of the shutter 407 by the density detection sensor. In FIG. 14, detection result of the density detection sensor is represented for each color separately. A vertical axis shows the detection result of the density detection sensor. A lateral axis shows measurement image density area (low density, medium density, high density). Further, in the following, a description is provided for a case where the shutter 407 is in the half-opened state only between the normal images page 1 and page 2 shown in FIG. 13.

In FIG. 14, a black round mark in each graph shows that the shutter 407 was half-opened. Further, a white round mark represented by a solid line shows that the shutter 407 was normally opened. Further, a white round mark represented by a dotted line shows that previous opening/closing of the shutter was normal. Further, a dotted line in each graph shows the detection result of the shutter rear side. It is noted that even if the density of the measurement image to be detected is changed, the density of the shutter rear side is not changed. Thereby, if the shutter 407 is in the closed state, the density value is equal to the density value of the shutter rear side. If the shutter 407 is in the half-opened state, it means that, comparing the latest detection result with the detection result this time, the detection result this time is closer to the density value of the shutter rear side than the latest detection result.

The image forming apparatus according to the present embodiment determines whether the shutter 407 is in the half-opened state or not by comparing vector approximating to the detection result of the shutter rear side with the detection result detected when operated normally. One example of the processing procedure of this determination is shown below as STEP 1 to STEP 6.

STEP 1: Detect density of the shutter rear side (Ref). STEP 2: Obtain latest detection result through which it is determined that the shutter is in the open state (n−1). STEP 3: Obtain detection result this time (n). STEP 4: Compare the normal and the latest detection result with the detection result this time. Then, determine whether ratio of the difference is more than predetermined ratio or not (for example, 10% or more) (((n)−(n−1)/(n)*100%). STEP 5: If it is determined, in STEP 4, the ratio of the difference is 10% or more, further determine whether (n) is a value closer to (Ref) than (n−1). STEP 6: If (n) is a value closer to (Ref) than (n−1), perform STEP 1 to 5 for the detection results of the rest of the colors. If it is found that (n) is a value closer to (Ref) than (n−1) for the rest of the colors (C, M, Y), it is determined that the shutter 407 is in the half-opened state and the measurement image is not normally detected. Then, the gradation correction is stopped.

As mentioned, in the image forming apparatus according to the present embodiment, it is possible to determine whether the shutter 407 is in the half-opened state or not. This enables to more surely restrict the occurrence of tone jump when performing the gradation correction.

Further, the descriptions have been provided in the first to the fourth embodiments with regard to the example where the detection sensor 117 is provided with the shutter 407 and the density of the image is adjusted based on the measurement result of the measurement image by the density detection sensor 117. However, relative misregistration of the yellow image, magenta image, cyan image, and black image may be corrected based on the measurement result of the measurement image by the density detection sensor 117. In this case, the stations 120, 121, 122, and 123 form a measurement image for separately measuring relative position of the images of each color component on the intermediate transfer body 106. Then, based on the measurement result of the measurement image by the density detection sensor 117, the image forming position in the respective stations 120, 121, 122, and 123 is adjusted. In the image forming apparatus, if the difference between a sensor output value corresponding to the measurement image for separately measuring the relative position of the images of each color component and a sensor output value corresponding to the reference member is a predetermined reference value or below, the image forming position needs to be adjusted based on the measurement result. In this case, it is possible to restrict a case where the relative position of the images of each color component is wrongly changed by the sensor output value output when the shutter 407 is not opened.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-153699, filed Aug. 3, 2015, which is hereby incorporated by reference herein in its entirety.

What is claimed is:

1. An image forming apparatus comprising:

an image bearing member;

an image forming unit configured to form an image on the image bearing member;

a measuring unit having a first sensor, a second sensor, and a shutter, and configured to measure a measurement image formed on the image bearing member, wherein the shutter protects the first sensor and the second sensor;

a driving unit configured to be driven to move the shutter, wherein, in a state in which the shutter is at a first position, the shutter prohibits measurement of the measurement image by the first sensor and the second sensor and wherein, in a state in which the shutter is at a second position, the measurement image is measured by the first sensor and the second sensor; and a controller configured to:

control the image forming unit to form the measurement image on the image bearing member, drive the driving unit to move the shutter to the second position, control the measurement unit to measure the measurement image, control whether or not to change an image forming condition of the image forming unit based on (i) a comparison result of a first output value corresponding to a measurement result of the first sensor and a first reference value and (ii) a comparison result of a second output value corresponding to a measurement result of the second sensor and a second reference value.

2. The image forming apparatus according to claim 1, wherein the image forming unit includes a first image forming unit configured to form an image of a first color based on a first image forming condition and a second image forming unit configured to form an image of a second color which is different from the first color based on a second image forming condition, wherein the measurement image includes a first measurement image formed by the first image forming unit and a second measurement image formed by the second image forming unit, wherein the controller is further configured to control the first sensor to measure the first measurement image and control the second sensor to measure the second measurement image, and wherein the controller changes the first image forming condition based on the first output value, and changes the second image forming condition based on the second output value.

3. The image forming unit according to claim 2, wherein the controller is further configured to control the first sensor to measure the shutter in a state in which the shutter is at the first position to generate the first reference value based on a measurement result of the shutter, and wherein the controller is further configured to control the second sensor to measure the shutter in a state in which the shutter is at the first position to generate the second reference value based on a measurement result of the shutter by the second sensor.

4. The image forming apparatus according to claim 3, wherein the controller is further configured to control the driving unit to move the shutter to the first position after the measurement image passes a measurement position of the measurement unit, control the first sensor to measure the shutter, generate the first reference value based on the measurement result of the shutter by the first sensor, control the second sensor to measure the shutter, and generate the second reference value based on the measurement result of the shutter by the second sensor.

5. The image forming apparatus according to claim 2, wherein the shutter comprises a reference member, the first reference value corresponds to a measurement result of the reference member by the first sensor, and the second reference value corresponds to a measurement result of the reference member by the second sensor.

6. The image forming apparatus according to claim 1, wherein the image bearing member conveys the image in a predetermined direction, wherein a measurement position of the first sensor is different from a measurement position of the second sensor in a direction orthogonal to the predetermined direction, and wherein the first measurement image and the second measurement image are formed at different positions in the direction orthogonal to the predetermined direction.

7. The image forming apparatus according to claim 1, wherein the controller is further configured to change the image forming condition based on a measurement result of the measurement unit in a case where a difference between the first output value and the first reference value is greater than a threshold value and a difference between the second output value and the second reference value is greater than a threshold value.

8. The image forming apparatus according to claim 7, wherein the controller is further configured to prohibit change of the image forming condition based on a measurement result of the measurement unit in a case where the difference between the first output value and the first reference value is less than the threshold value.

9. The image forming apparatus according to claim 1, further comprising a transfer unit configured to transfer the image formed on the image bearing member to a sheet.

10. An image forming apparatus comprising:

an image bearing member;

an image forming unit configured to form an image on the image bearing member;

a measuring unit having a first sensor, a second sensor, and a shutter, and configured to measure a measurement image formed on the image bearing member;

a motor configured to drive the shutter; and a controller configured to:

control the image forming unit to form the measurement image on the image bearing member;

control the motor to open the shutter;

control the measuring unit to measure the measurement image; and adjust an image forming condition based on the measurement result by the measurement unit, wherein the controller is configured to determine whether the shutter is opened or not based on a measurement result by the first sensor and a measurement result by the second sensor, and wherein, in a case where the shutter is not opened, the shutter prevents the measuring unit from measuring the measurement image.

11. The image forming apparatus according to claim 10, wherein the measurement image includes a predetermined measurement image, and the controller is configured to determine whether the shutter is opened or not based on the measurement result of the predetermined measurement image by the first sensor and the measurement result of the predetermined measurement image by the second sensor.

12. The image forming apparatus according to claim 10, wherein the measurement image includes a first measurement image and a second measurement image, and the controller is configured to determine whether the shutter is opened or not based on the measurement result of the first measurement image by the first sensor and the measurement result of the second measurement image by the second sensor.

13. The image forming apparatus according to claim 12, wherein the image bearing member conveys the measurement image in a predetermined direction, wherein a measurement region of the first sensor is different from a measurement region of the second sensor in a direction orthogonal to the predetermined direction, and wherein the first measurement image and the second measurement image are formed at different positions in the direction orthogonal to the predetermined direction.

14. The image forming apparatus according to claim 10, wherein the controller prohibits adjustment of the image forming condition based on the measurement result of the measuring unit in a case where the shutter is not opened.

15. The image forming apparatus according to claim 10, wherein the controller is configured to control, after completion of measuring of the measurement image by the measuring unit, the motor to perform closing of the shutter.

* * * * *